United States Patent [19]

Ryll et al.

[11] Patent Number: 4,698,030

[45] Date of Patent: Oct. 6, 1987

[54] CONNECTOR HAVING ROTATABLE INSERT FOR RETAINING TERMINALS

[75] Inventors: Jurgen H. Ryll, Egelsbach; Rainer W. Ullrich, Dreieich-Offenthal, both of Fed. Rep. of Germany

[73] Assignee: AMP Incorporated, Harrisburg, Pa.

[21] Appl. No.: 839,306

[22] Filed: Mar. 13, 1986

[30] Foreign Application Priority Data

Mar. 21, 1985 [DE] Fed. Rep. of Germany ..... 8508465

[51] Int. Cl.[4] ..... H01R 13/502

[52] U.S. Cl. ..... 439/752; 439/732

[58] Field of Search ..... 339/210 R, 210 M, 61 M, 339/61 R, 211, 212, 213 R, 206 P, 206 R

[56] References Cited

U.S. PATENT DOCUMENTS 3,328,745 6/1967 Paullus ..... 339/61 M 3,404,364 10/1968 Paullus et al. ..... 339/61 M 4,284,320 8/1981 Nix et al. ..... 339/210 M

FOREIGN PATENT DOCUMENTS 0496765 12/1938 United Kingdom ..... 339/210 R

*Primary Examiner*—Gil Weidenfeld

*Assistant Examiner*—Thomas M. Kline

*Attorney, Agent, or Firm*—Thomas G. Terrell

[57] ABSTRACT

Multicontact electrical connector comprises a connector housing which has one part that is movable in a perpendicular direction to the housing axis. The terminal receiving cavities extend through the movable part and through the relatively fixed part. When the movable part is in one position, the terminals can be inserted into the cavities. When the movable part is moved to another position, a shoulder is formed in each cavity which prevents removal of the terminals from the cavities. The two parts are each plastic moldings and can be assembled to each other in a simple assembly operation.

11 Claims, 9 Drawing Figures

CONNECTOR HAVING ROTATABLE INSERT FOR RETAINING TERMINALS

FIELD OF THE INVENTION

This invention relates to multicontact electrical connectors of the type having a housing which has a movable part for purposes of retaining the terminals in the housing cavities. The invention is particularly directed to the achievement of a low-cost connector which is composed of plastic molded parts and which has the movable part contained in the relatively nonmovable part.

BACKGROUND OF THE INVENTION

U.S. Pat. No. 3,404,364 describes a multicontact electrical connector having an insulating housing which has one part that is movable in a direction perpendicular to the housing axis. The terminal receiving cavities extend through the movable part so that the terminal can be inserted into the cavities when the movable is in one position. After insertion, the movable part is moved to a second position which forms a shoulder in each cavity so that the terminals cannot be removed.

This type of retention system for retaining terminals in the cavities in an electrical connector is extremely reliable for the reason that it does not depend upon retention lances or the like on the terminals which lances might be damaged prior to insertion of the terminals into the cavities. Furthermore, it is not possible with retention systems of this type to insert the terminals into the cavities unless the movable part is in its proper position for terminal insertion and it is impossible to move the movable part to the position in which it retains the terminals in the cavities unless the terminals are all fully inserted into the cavities. The movable part thus ensures that the terminals have been properly assembled and that the connector will not have partially inserted terminals when it is put to use.

The connector assembly shown in U.S. Pat. No. 3,404,364 is a relatively complex type of connector assembly composed of a metal outer shell, several inserts contained in the shell in addition to the movable insert part, and finally a separate ring on the connector shell for moving the movable part to retain the terminals. The present invention is directed to the achievement of a relatively simplified connector having a movable part for contact retaining purposes which can be produced by plastic molding processes and which can be assembled by a simple assembly operation.

THE INVENTION

The invention comprises a multicontact electrical connector of the type having a housing which has a mating face, a wire entry face, and a longitudinal axis which extends through the housing. The housing is made up of first and second aligned housing sections, the first section having the mating face thereon and the second section having the wire entry face thereon. A plurality of terminal receiving cavities extend through the housing and parallel to the longitudinal axis, each cavity being made up of a first cavity portion which is in the first housing section and a second cavity portion which is in the second housing section. The first and second housing sections are movable relative to each other in a plane which is perpendicular to the longitudinal axis of the housing between a terminal receiving position and a terminal retaining position. The first and second cavity portions are aligned when the housing parts are in the terminal receiving position and are slightly misaligned when the housing sections are in the terminal retaining position so that terminals which were previously inserted cannot be removed from the cavities. The connector is characterized in that the first and second housing sections have opposed first and second internal faces. One of the housing sections has a hood which surrounds and extends beyond its internal face and the other housing section is contained in, and surrounded by, the hood. The hood has an internal hood surface and the other housing section has a peripheral surface which is opposed to, and substantially against, the internal hood surface. The peripheral surface and the internal hood surface having guiding portions for guiding the sections during movement between the terminal receiving and terminal retaining positions.

In accordance with further embodiments, the first and second housing sections are one-piece molded plastic members. In one embodiment, the housing sections are cylindrical and are rotated relative to each other between the terminal receiving and terminal retaining positions. In another embodiment, the housing sections have a rectangular cross section and are moved linearly between the receiving and retaining positions.

THE DRAWING FIGURES

THE DISCLOSED EMBODIMENT

Figure 1:
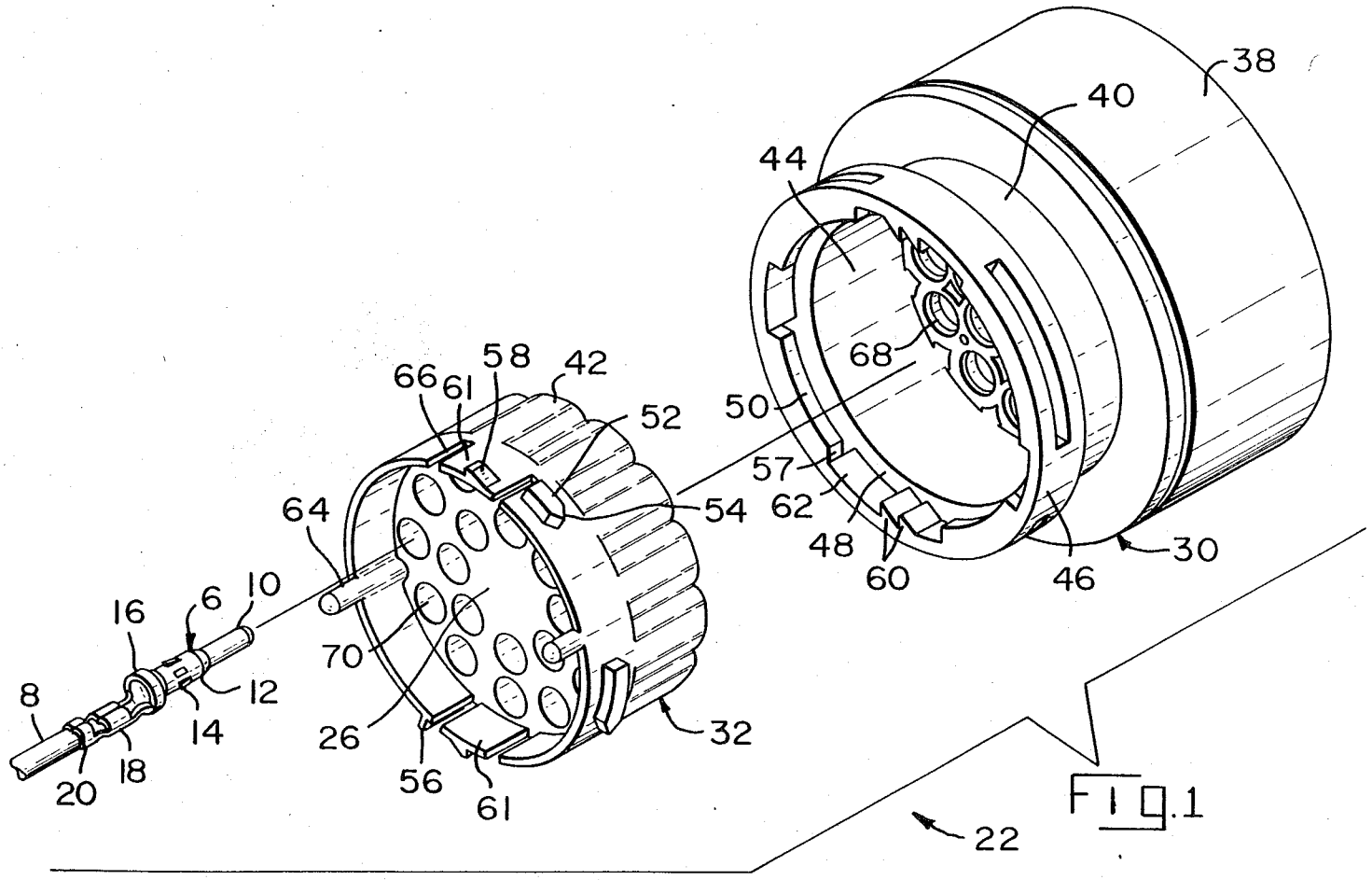
FIG. 1 is a perspective view of a connector in accordance with the invention with the second housing section in alignment with, and exploded from, the first housing section.
Figure 2:
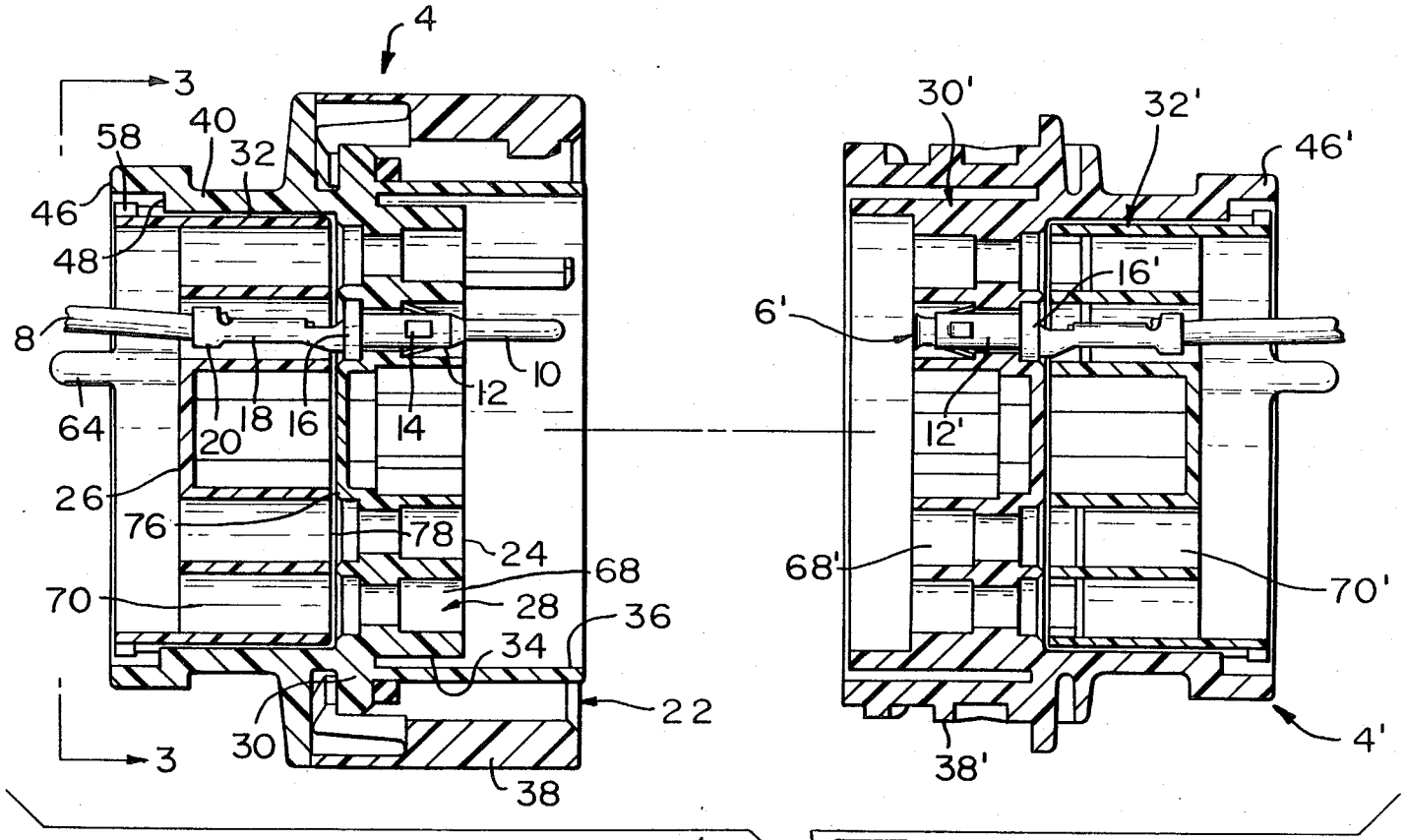
FIG. 2 is a side view, partially in section, showing two connectors in accordance with the invention which are intended to be mated or coupled to each other to form a connector assembly.

FIG. 2 shows a connector assembly 2 which is composed of two individual connectors 4, 4', each of which is constructed in accordance with the invention. In this description, the term "connector" is used to denote an individual part containing terminals which is mated to a complementary part also containing terminals. When the two parts are mated with each other, a connector assembly is produced. In the description which follows, only the connector 4 will be described in detail and the same reference numerals, differentiated by prime marks, will be used to denote corresponding structural features of the two connectors 4, 4'.

The connector 4 contains a plurality of terminal pins 6 which are secured by crimping onto wires 8. Each terminal pin has a forward cylindrical contact portion 10, a somewhat enlarged adjacent cylindrical portion 12 having rearwardly extending retaining lances 14 thereon, an intermediate enlarged cylindrical collar 16, and crimp portions 18, 20 by means of which the terminal is crimped onto the wire strands and the insulation of the wire 8.

The connector 4' has socket terminals 6' therein which also have the cylindrical portion as shown at 12' and a collar as shown at 16'.

The connector 4 comprises an insulating housing assembly 22 having a mating face 24, a wire entry face 26 and cavities 28 which extend through the housing assembly and parallel to the longitudinal axis thereof which extends through the assembly. The housing assembly 22 is made up of a first housing section 30 on which the mating face 24 is provided and a second housing section 32 on which the wire entry face is provided. The housing sections have opposed internal surfaces as shown at 76, 78, FIG. 4, which are substantially against each other.

The housing section 30 has an external cylindrical surface 34 and a forward hood 36 which surrounds and extends beyond the mating face 24. A locking nut or locking ring 38 is rotatably captured on the connector part 4 and is internally threaded for cooperation with threads 38' on the external surface of the connector part 4' so that the two parts can be drawn into engagement with each other and locked in their mated positions.

The first housing section 30 has a rearwardly extending hood 40 which surrounds and extends beyond the internal surface 78 and which receives the second housing section 32. The second housing section has a cylindrical surface 42 which bears substantially against the internal cylindrical surface 44 of the hood. The parts are dimensioned so that they can be rotated relative to each other through a slight angle as will be described below.

The hood has an enlarged rim 46 within which there is provided a rearwardly facing shoulder 48 which extends circumferentially around the rim. Four spaced-apart flanges 50 are provided in the rim and extend radially inwardly with space being provided between each adjacent pair of flanges. These flanges are spaced from the shoulder surface 48 by a distance which is sufficient to receive guide ears 52 on the surface 42 of the second housing section 32. These ears are pointed at one of their ends, and the ears and the flanges 50 are dimensioned such that the second housing section 32 can be assembled to the first housing section 30 by aligning the proper ears 52 with the gaps or spaces between the flanges 50 and then moving the second housing section into the enclosure of the hood 40. When the ears 52 are against the shoulder surface 48, the second housing section is rotated slightly until the pointed ends of the ears move behind the flanges 50 as shown best in FIG. 3. The second housing section can be rotated a further distance from the position shown in FIG. 3 as will be explained below.

Figure 3:
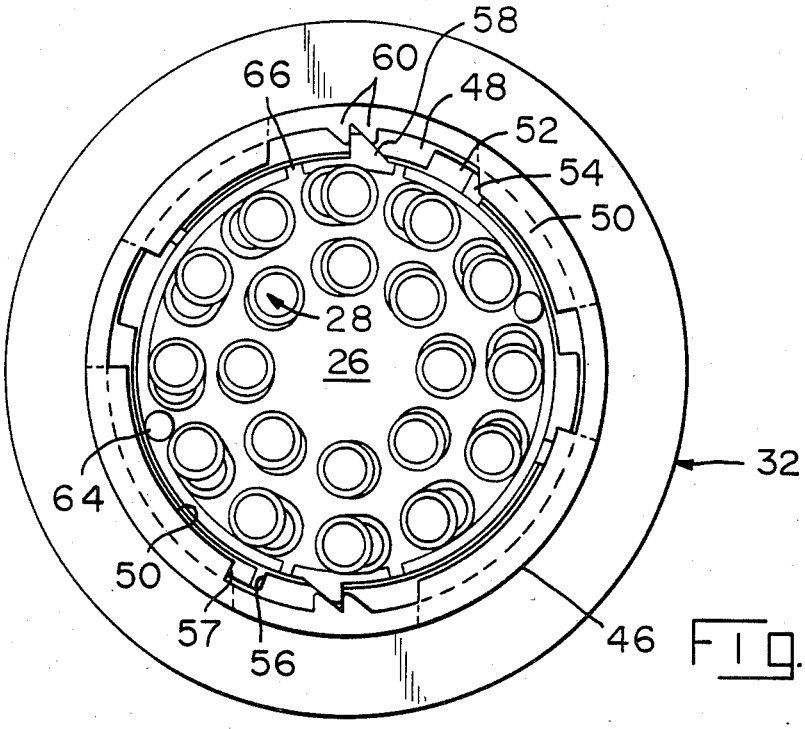
FIG. 3 is a view looking in the direction of the arrows 3—3 of FIG. 2.

The limit of rotation of the second housing section 32 relative to the first housing section 30 is determined by a stop 56 which projects from the surface 42 and which comes to rest against a side 57 of one of the flanges 50 as shown in FIG. 3. It is desirable also to provide a locking or detent system between the two housing sections to control the rotary movement of the second section relative to the first section. In the embodiment shown, a detent system is provided in that teeth 58 are provided on opposite sides of the surface 42 and opposed pairs of teeth 60 are provided on the opposed surfaces 62 between adjacent flanges 50 of the first housing part. When the second housing part is assembled to the first housing part the second housing part will be rotated in a clockwise direction to the position shown in FIG. 3. When the second housing section is rotated to the position shown, the teeth 58 will be between the two teeth 60 and the ears will have moved behind the flanges 50. Thereafter, the second housing part can be rotated until the teeth 58 are beyond the teeth 60.

The teeth 58, 60 will normally prevent movement of the second housing part in an anticlockwise direction as viewed in FIG. 3; however, it is desirable to permit such anticlockwise direction under certain circumstances for terminal removal as will be described below. Such anticlockwise movement is possible by virtue of the fact that the wire entry face 26 is recessed from the rearward end of the section 32 so that a circular flange surrounds the face 26. Spaced-apart slots 66 are provided in this flange on each side of the portion on which the teeth 58 are mounted so that this portion of the flange is a flexible cantilever beam. The beam sections can thus be flexed inwardly to disengage the teeth 58 from the teeth 60 and thereby permit rotation of the second housing section in an anticlockwise direction. Handles or fingerpieces 64 are provided on the circular flange to facilitate rotation of the second housing section by the technician.

Figure 4:
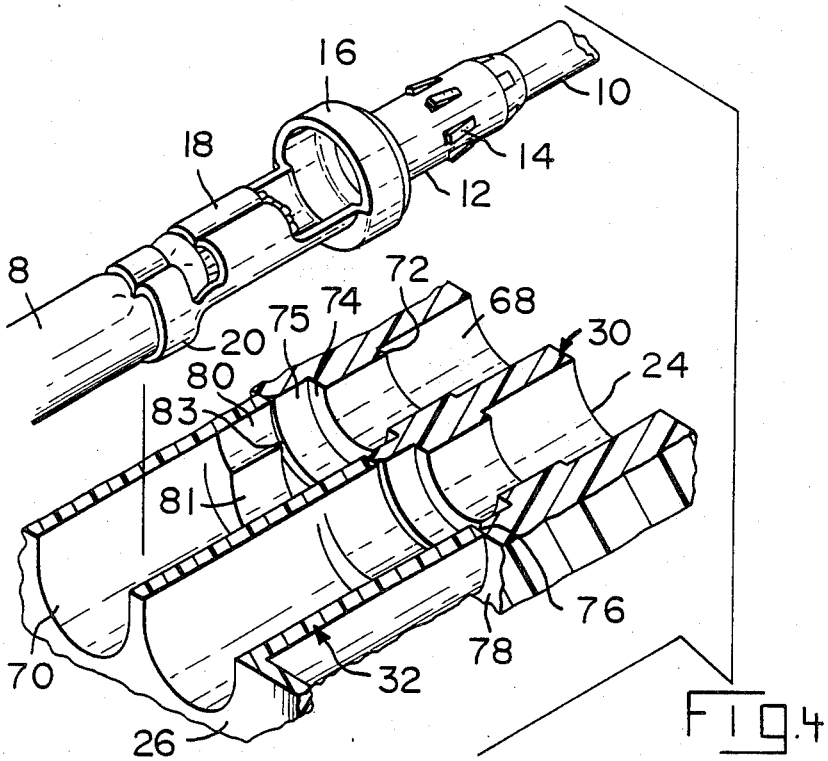
FIG. 4 is a fragmentary perspective view showing a portion of the two housing sections and showing side-by-side cavities with a single terminal in alignment with one of the cavities.

Each of the cavities 28 which receives a terminal 4 is composed of two cavity portions, a first cavity portion 68 which is in the housing section 30 and a second cavity portion 70 which is in the housing 32. As shown in FIG. 4, each cavity portion 68 has a forwardly facing shoulder 72, that is facing toward the mating face, against which the lances 14 bear when the terminals are fully inserted. The shoulder 72 is spaced from a rearwardly facing shoulder 74, the two shoulders being separated by a somewhat reduced diameter portion of the cavity. The rearwardly facing shoulder 74 adjoins a cylindrical surface 75 against which the surface of collar 16 bears when the terminal is inserted, the shoulder 74 serving as a forward stop that prevents rightward movement of the terminal from the position shown in FIG. 5. The second cavity portion 70 in the second housing section 32 is somewhat enlarged adjacent to the wire entry face 26 and has a surface 80 which is coplanar, or almost coplanar, with the surface 75 of the first cavity portion. An adjacent surface 81 which intersects the surface 80 has a smaller radius of curvature as clearly shown in FIG. 4.

Figure 5:
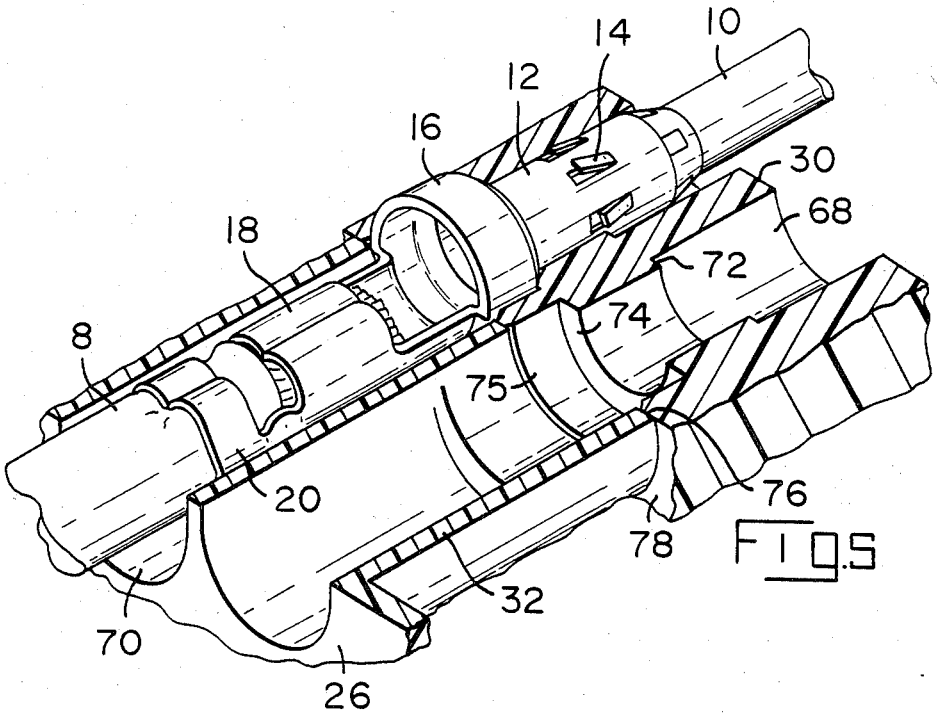
FIGS. 5 and 6 are views similar to FIG. 4, FIG. 5 showing the terminal as positioned in one of the cavities while the housing sections are in their terminal receiving positions and FIG. 6 showing the positions of the parts when the housing sections are in their terminal retaining positions.
Figure 6:
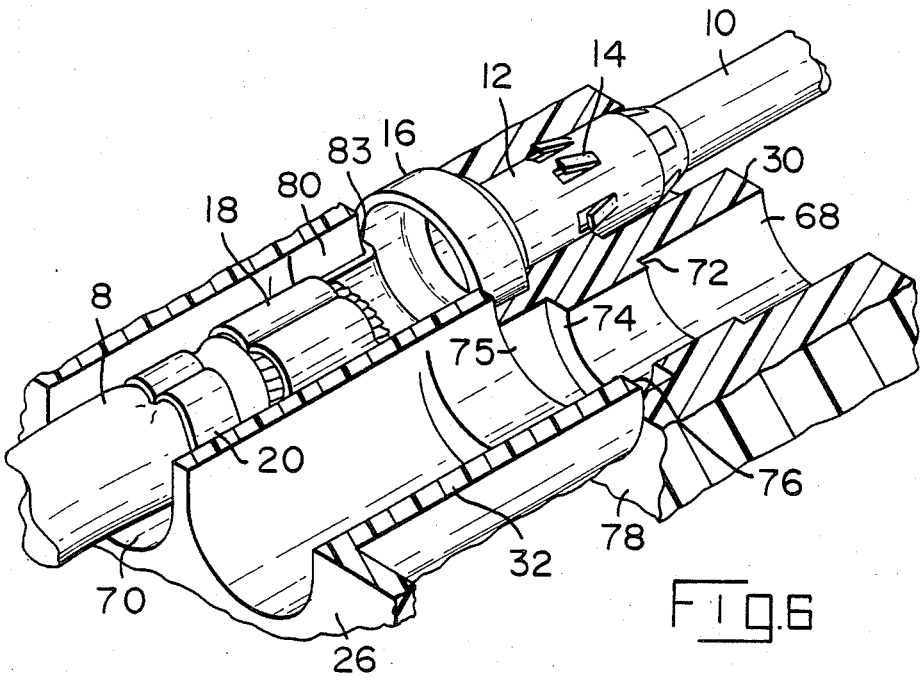
Figure 7:
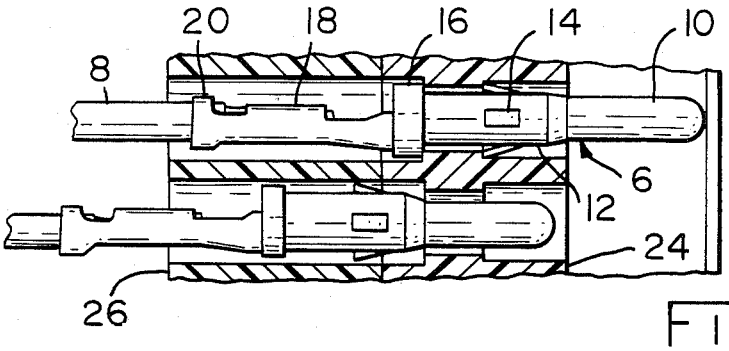
FIGS. 7 and 8 are sectional plan views taken through the connector housing showing the manner in which the terminals are inserted into the cavities when the housing sections are in the terminal receiving position (FIG. 7) and the manner in which the terminals are retained when the housing sections are in the terminal retaining position (FIG. 8).
Figure 8:
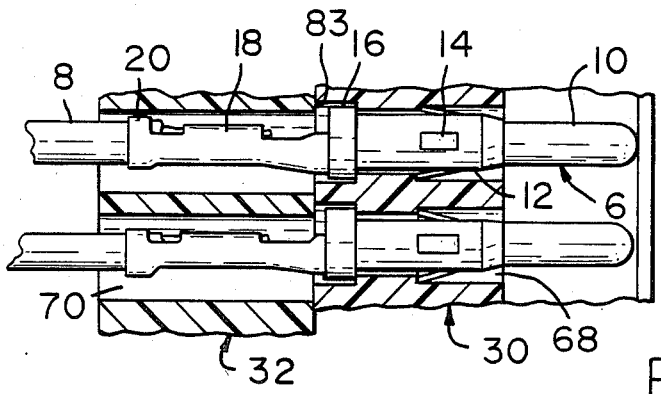

When the two housing sections are in the positions of FIGS. 4 and 7, the terminals can be inserted into the cavities from the wire entry face 26 until the collars 16 come to rest against the shoulders 74. After insertion, the collars 16 will be entirely contained in the first cavity portions 68 as shown in FIG. 5 and the rearward edge of the collar 16 will be substantially coplanar or recessed from the internal surface 78 of the first housing section. The adjacent portion of the terminal is of a lesser radius of curvature and the second housing section can, therefore, be rotated through a slight angle until the edge 83 of the surface 80 moves beyond the edge of the collar 16 as shown in FIGS. 6 and 8. When the parts are in the positions of FIGS. 6 and 8, it thus is impossible to move the terminals from the cavities towards the wire entry face. At the same time and as noted above, it is impossible to move the second housing section from the position of FIG. 5 to the position of FIG. 6 unless the terminals are fully inserted into the cavities; if one or more terminals are not fully inserted, the collar of the terminal will prevent movement of the second housing section to the positions of FIGS. 6 and 8.

The precise configuration of the cavity for a connector in accordance with the invention will depend upon the configuration of the terminals used with the connector. It is necessary, however, to design the terminal and the cavity such that a portion of the second housing section will interfere with extraction of the terminals from the cavities after the second housing section is moved to its terminal retaining section.

As shown in FIG. 3, the terminals of the connector shown are arranged in two circular arrays which surround the axis of the connector. Clearly, the cavities in the inner array do not move by as great a distance as do the cavities in the outer array or outer ring and these cavities must be of a slightly different shape to compensate for the difference in movement. In the embodiment shown of a cylindrical connector, a cavity cannot be provided on the axis for the reason that there can be no relative movement or displacement in a direction perpendicular to the housing axis.

Figure 9:
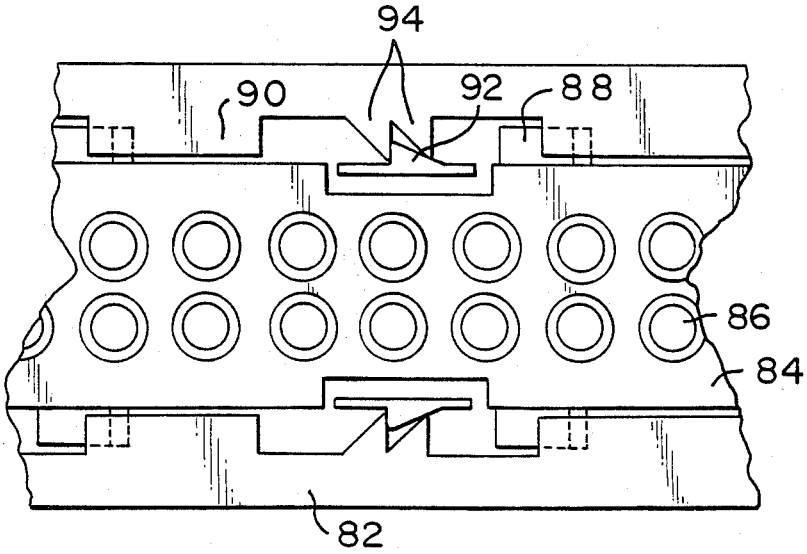
FIG. 9 is a fragmentary view showing the wire entry face of a connector in accordance with the invention having a rectangular cross section.

FIG. 9 shows the wire entry end of a portion of a rectangular connector having first and second housing sections 82, 84, cavities 86 for the terminals, and ears 88 extending from the housing section 84. Flanges 90 are provided on the first housing section and teeth 92, 94 are provided for locking purposes as described above. In this embodiment, the housing sections move linearly relative to each other along a straight line rather than along an arc.

As described above, a connector in accordance with the invention provides for positive locking of the terminals in the cavities of the housing and assurance that not only are the terminals are retained in the cavities, but that the terminals have been fully inserted since the second housing section cannot be rotated to the terminal retaining position unless the terminals are fully inserted.

The embodiment shown comprises only plastic molded parts and can, therefore, be produced at an extremely low cost. The housing parts are assembled to each other by a relatively simple assembly operation and the connector is fuly serviceable in that the terminals can be extracted from the connector housing if it is ever necessary to do so.

What is claimed is:

1. A multicontact electrical connector of the type comprising a housing assembly having a mating face, a wire entry face, and a longitudinal axis which extends through the housing assembly, the housing assembly comprising first and second aligned housing sections, the first section having the mating face thereon, the second section having the wire entry face thereon, a plurality of terminal receiving cavities extending through the housing assembly and parallel to the longitudinal axis, each cavity having a first cavity portion which is in the first section and a second cavity portion which is in the second section, the first and second housing sections being movable relative to each other in a plane which is perpendicular to the longitudinal axis between a terminal receiving position and a terminal retaining position, the first and second cavity portions being aligned when the first and second housing sections are in terminal receiving positions so that terminals can be inserted into the cavities, the first and second cavity portions being misaligned when the first and second sections are in the terminal retaining positions so that inserted terminals will be retained in the cavities, wherein;

the first and second housing sections have first and second internal faces which are opposed to each other, one of the housing sections having a hood which surrounds, and extends from its internal face, the other housing section being contained in, and surrounded by, the hood, a locking system being provided for locking the housing sections in their terminal retaining positions and comprising radially extending locking teeth on said hood and on said peripheral surface, the teeth on the hood being inter-engageable with those on said peripheral surface, the hood having an internal hood surface and the other housing section having a peripheral surface which is opposed to, and substantially against the internal hood surface, the peripheral surface and the internal hood surface having guiding portions for guiding the sections during movement between the terminal receiving and terminal retaining positions, said teeth on one of the housing sections being provided on flexible arms thereon.

2. A multicontact electrical connector as set forth in claim 1 wherein each of the first and second housing sections is comprised of plastic material.

3. A multicontact electrical connector of the type comprising a housing assembly having a mating face, a wire entry face, and a longitudinal axis which extends through the assembly, the housing assembly comprising first and second aligned housing sections, the first section having the mating face thereon, the second section having the wire entry face thereon, a plurality of terminal receiving cavities extending through the housing assembly and parallel to the longitudinal axis, each cavity having a first cavity portion which is in the first section and a second cavity portion which is in the second section, the first and second housing sections being movable relative to each other in a plane which is perpendicular to the longitudinal axis between a terminal receiving position and a terminal retaining position, the first and second cavity portions being aligned when the first and second housing sections are in the terminal receiving positions so that terminals can be inserted into the cavities, the first and second cavity portions being misaligned when the first and second sections are in the terminal retaining position so that inserted terminals will be retained in the cavities, wherein:

the first and second housing sections have first and second internal faces which are opposed to each other, one of the housing sections having a hood which surrounds, and extends from its internal face, the other housing section being contained in, and surrounded by, the hood, the hood having an internal hood surface and the other housing section having a peripheral surface which is opposed to, and substantially against the internal hood surface, the peripheral surface and the internal hood surface having guiding portions for guiding the sections during movement between the terminal receiving and terminal retaining positions, each of the first and second housing sections being comprised of plastic material and the housing assembly being cylindrical, and the first and second housing sections being rotated relative to each other during movement between the terminal receiving and terminal retaining positions.

4. A multicontact electrical connector as set forth in either of claims 1 or 3, wherein the hood extends from the first housing section.

5. A multicontact electrical connector as set forth in claim 4 wherein the guiding portions comprise at least one guide ear on said second housing section and a guiding surface for the guide ear on the first housing section.

6. A multicontact electrical connector as set forth in claim 3 wherein a locking system is provided for locking the first and second housing sections in their terminal retaining positions, the locking system comprising radially extending, inter-engageable locking teeth on the hood and on said peripheral surface.

7. A multicontact electrical connector as set forth in claim 6 wherein the second housing section is radially flexible in the vicinity of the radially extending locking teeth thereby to permit disengagement of the locking teeth and relative movement of the first and second housing sections from the terminal retaining position to the terminal receiving position.

8. A multicontact electrical connector as set forth in claim 7 wherein the second housing section which is radially flexible has a cantilever arm, the radially extending locking teeth being on the cantilever arm.

9. A multicontact electrical connector as set forth in claim 3 wherein the cavities are arranged ina circular array which concentrically surrounds the longitudinal axis of said assembly.

10. A multicontact electrical connector as set forth in claim 9 wherein the circular array comprises an inner ring of cavities and an outer ring of cavities, the outer ring of cavities being spaced from the longitudinal axis of said assembly by a distance which is greater than the distance from said axis to the inner ring of cavities.

11. A multicontact electrical connector of the type comprising a housing assembly having a mating face, a wire entry face, and a longitudinal axis which extends through the housing assembly, the housing assembly comprising first and second aligned housing sections, the first section having the mating face thereon, the second section having the wire entry face thereon, a plurality of terminal receiving cavities extending through the housing assembly and parallel to the longitudinal axis, each cavity having a first cavity portion which is in the first section and a second cavity portion which is in the second section, the first and second housing sections being movable relative to each other in a plane which is perpendicular to the longitudinal axis between a terminal receiving position and a terminal retaining position, the first and second cavity poritons being alinged when the first and second housing sections are in the terminal receiving position so that terminals can be inserted into the cavities, the first and second cavity portions being misaligned when the first and second sections are in the terminal retaining position so that terminals can be inserted into the cavities, wherein:

the first and second housing sections have first and second internal faces which are opposed to each other, one of the housing sections having a hood which surrounds, and extends from its internal face, said hood having radially extending locking projections thereon, the other housing section being contained in and surrounded by, the hood, the hood having an internal hood surface and the other housing section having a peripheral surface which is opposed to, and substantially against the internal hood surface, and having radially extending locking projections thereon which are inter-engageable with the locking projections of the hood to lock the housing sections in their terminal retaining position, the peripheral surface and the internal hood surface having guiding portions for guiding the sections during movement between the terminal receiving and terminal retaining positions, said guiding portions being in the form of ears and cooperating guide surfaces on the first and second housing sections.

* * * * *